US006596128B2

(12) United States Patent
Westbrook

(10) Patent No.: US 6,596,128 B2
(45) Date of Patent: Jul. 22, 2003

(54) COKE OVEN FLUE GAS SHARING

(75) Inventor: Richard W. Westbrook, Concord, TN (US)

(73) Assignee: Sun Coke Company, Knoxville, TN (US)

( * ) Notice: Subject to any disclaimer, the term of this patent is extended or adjusted under 35 U.S.C. 154(b) by 250 days.

(21) Appl. No.: 09/783,195

(22) Filed: Feb. 14, 2001

(65) Prior Publication Data

US 2002/0134659 A1 Sep. 26, 2002

(51) Int. Cl.[7] ..... C10B 5/00; C10B 5/02; C10B 5/04; C10B 23/00

(52) U.S. Cl. ..... 202/113; 202/96; 202/99; 202/108; 202/133; 202/138; 202/139; 202/220; 201/13; 201/14

(58) Field of Search ..... 202/96, 99, 108, 202/113, 116, 124, 125, 126, 127, 133, 138, 139, 220; 201/13, 14

(56) References Cited

U.S. PATENT DOCUMENTS

| | | | | |
|---|---|---|---|---|
| 3,839,156 A | | 10/1974 | Jakobi et al. | |
| 3,963,582 A | | 6/1976 | Helm et al. | |
| 4,004,983 A | | 1/1977 | Pries | |
| 4,235,830 A | | 11/1980 | Bennett et al. | |
| 4,249,997 A | | 2/1981 | Schmitz | |
| 4,330,372 A | | 5/1982 | Cairns et al. | |
| 4,704,195 A | | 11/1987 | Janicka et al. | |
| 5,062,925 A | | 11/1991 | Durselen et al. | |
| 5,114,542 A | * | 5/1992 | Childress et al. | 201/15 |
| 5,968,320 A | | 10/1999 | Sprague | |
| 6,139,692 A | | 10/2000 | Tamura et al. | |

FOREIGN PATENT DOCUMENTS

CN 1128788 A 8/1996

OTHER PUBLICATIONS

JP 551 062 84A2 Chamber–Type Coke Oven (abstract only) Aug. 14, 1980.

JP 591 554 89A2 Regulation of Coke Oven Pressure (abstract only) Sep. 4, 1984.

JP 102 657 78A2 Combustion Chamber of Coke Oven (abstract only) Oct. 6, 1998.

DE 391 1295 Process and Equipment for Reducing the Nitrogen Oxide Content of Flue Gases From Coke Oven Batteries (abstract only) Nov. 9, 1989.

DE 334 7244 Process for Operating a Coke Oven Battery (abstract only) Jul. 11, 1985.

DE 313 4327 Device for Improving the Flow Path of Gases Entering the Combustion Chamber of Industrial Gas–Fired Furnaces, in particular of Coke Ovens (abstract only) Mar. 10, 1983.

* cited by examiner

*Primary Examiner*—Jerry D. Johnson
*Assistant Examiner*—Alexa A. Doroshenk
(74) *Attorney, Agent, or Firm*—Luedeka,Neely & Graham, PC

(57) ABSTRACT

The invention provides a method and apparatus for decreasing gas flow rates in a sole flue gas system for a coke oven during at least an initial coking operation after charging a coking oven with coal. The method includes providing a duct system between a first coke oven having a first coking chamber and a second coke oven having a second coking chamber to direct at least a portion of gas from a gas space in first coking chamber to the second coke oven thereby reducing a gas flow rate in the first sole flue gas system of the first coke oven. Reduction in sole flue gas flow rates has a beneficial effect on product throughput, the life of the coke oven and environmental control of volatile emissions from coke ovens.

28 Claims, 6 Drawing Sheets

View 4-4

View 3-3

View 4-4

View 4-4

COKE OVEN FLUE GAS SHARING

FIELD OF THE INVENTION

The invention relates to coke ovens and in particular to methods and apparatus for operating coke ovens which improve oven life, reduce emissions and increase coke yield from the ovens.

BACKGROUND

Coke is a solid carbon fuel and carbon source used to melt and reduce iron ore in the production of steel. During an iron-making process, iron ore, coke, heated air and limestone or other fluxes are fed into a blast furnace. The heated air causes combustion of the coke which provides heat and a source of carbon for reducing iron oxides to iron. Limestone or other fluxes may be added to react with and remove the acidic impurities, called slag, from the molten iron. The limestone-impurities float to the top of the molten iron and are skimmed off.

In one process, known as the "Thompson Coking Process," coke used for refining metal ores is produced by batch feeding pulverized coal to an oven which is sealed and heated to very high temperatures for 24 to 48 hours under closely controlled atmospheric conditions. Coke ovens have been used for many years to covert coal into metallurgical coke. During the coking process, finely crushed coal is heated under controlled temperature conditions to devolatilize the coal and form a fused mass having a predetermined porosity and strength. Because the production of coke is a batch process, multiple coke ovens are operated simultaneously, hereinafter referred to as a "coke oven battery".

At the end of the coking cycle, the finished coke is removed from the oven and quenched with water. The cooled coke may be screened and loaded onto rail cars or trucks for shipment or later use or moved directly to an iron melting furnace.

The melting and fusion process undergone by the coal particles during the heating process is the most important part of the coking process. The degree of melting and degree of assimilation of the coal particles into the molten mass determine the characteristics of the coke produced. In order to produce the strongest coke from a particular coal or coal blend, there is an optimum ratio of reactive to inert entities in the coal. The porosity and strength of the coke are important for the ore refining process and are determined by the coal source and/or method of coking.

Coal particles or a blend of coal particles are charged into hot ovens on a predetermined schedule, and the coal is heated for a predetermined period of time in the ovens in order to remove volatiles from the resulting coke. The coking process is highly dependent on the oven design, the type of coal and conversion temperature used. Ovens are adjusted during the coking process so that each charge of coal is coked out in approximately the same amount of cycle time. Once the coal is coked out, the coke is removed from the oven and quenched with water to cool it below its ignition temperature. The quenching operation must also be carefully controlled so that the coke does not absorb too much moisture. Once it is quenched, the coke is screened and loaded into rail cars or trucks for shipment.

As the sources of high grade coal for coking operations continue to decrease, less desirable coals are being used to produce coke. Such less desirable coals may have variable moisture and volatile matter content which affect the coking operations. Control of the coking operation is important to provide high quality coke for metallurgical processes. There continues to be a need for improved coking processes and apparatus for providing high quality coke.

SUMMARY OF THE INVENTION

With regard to the above and other advantages, the invention provides a coke oven battery including at least a first coke oven and a second coke oven adjacent the first coke oven. Each of the first and second coke ovens contains a coking chamber defined by chamber sidewalls, chamber roof and chamber floor, wherein each coking chamber includes a gas space above a coke bed. The chamber floor of the first coke oven is heated by a first sole flue gas system and the chamber floor of the second coke oven is heated by a second sole flue gas system. At least one of the chamber sidewalls between the first and second coke ovens contains at least one downcomer in flow communication between the gas space of the first coking chamber and the first sole flue gas system for directing flue gases from the gas space of the first coking chamber to the first sole flue gas system. The coke oven battery also contains a connecting gas conduit in gas flow communication between the gas space of the first coking chamber and the gas space of at least the second coking chamber or the sole flue gas system of at least the second coke oven for directing at least a portion of flue gas from the gas space of the first coking chamber to the second coke oven in order to reduce a gas flow rate in the first sole flue gas system.

In another aspect the invention provides a flue gas sharing system for a coke oven battery containing at least a first coke oven and a second coke oven. The first coke oven has a first sole flue gas system, a first coking chamber and a first gas space above a coke bed in the first coking chamber. The second coke oven has a second sole flue gas system, a second coking chamber and a second gas space above a coke bed in the second coking chamber. The flue gas sharing system includes a refractory lined duct in gas flow communication between the first gas space and at least the second gas space or the second sole flue gas system whereby a flue gas flow rate in the first sole flue gas system is reduced compared to a flue gas flow rate in the first sole flue gas system in the absence of the refractory lined duct.

In yet another aspect the invention provides a method for decreasing gas flow rates in a sole flue gas system for a coke oven during at least an initial coking operation after charging a coking oven with coal. The method includes providing a duct system between a first coke oven having a first coking chamber, a first gas space above a first coke bed and a first sole flue gas system and a second coke oven having a second coking chamber, a second gas space above a second coke bed and a second sole flue gas system to direct at least a portion of gas in the first gas space to at least the second gas space or the second sole flue gas system for the second coke oven thereby reducing a gas flow rate in the first sole flue gas system.

The invention provides a unique system for reducing peak oven temperatures and gas flow rates in coking chambers in order to prolong the life of the refractory lined ovens and to further reduce undesirable emissions from the coking operation. The system is adaptable to use with at least two coke ovens and may be used with three or more the coke ovens in a coke oven battery. Furthermore, the system is readily adaptable to existing coke ovens without major modifications of the ovens and without substantial changes in coke oven operations.

As will be described in more detail below, coke oven temperatures are dependent on the quality of coal, the amount of coal charged to the oven and the amount of combustion air provided to the oven. From a practical point of view, prior to the invention, the only way to control peak oven temperature was to reduce the charge of coal to the oven for a given coal source. A coal high in volatiles results in the need for additional combustion air being provided to an oven to assure complete combustion of the volatiles. However, the amount of combustion air provided to an oven is limited by the natural or induced draft system for the coke battery. Additional combustion air reduces the natural or induced draft in a coke oven battery and may result in increased emissions from the ovens during charging and coking operations. The invention provides a unique means for operating a coke oven battery so that increased coke production may be achieved.

BRIEF DESCRIPTION OF THE DRAWINGS

Further advantages and benefits of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE PREFERRED EMBODIMENTS

Figure 1:
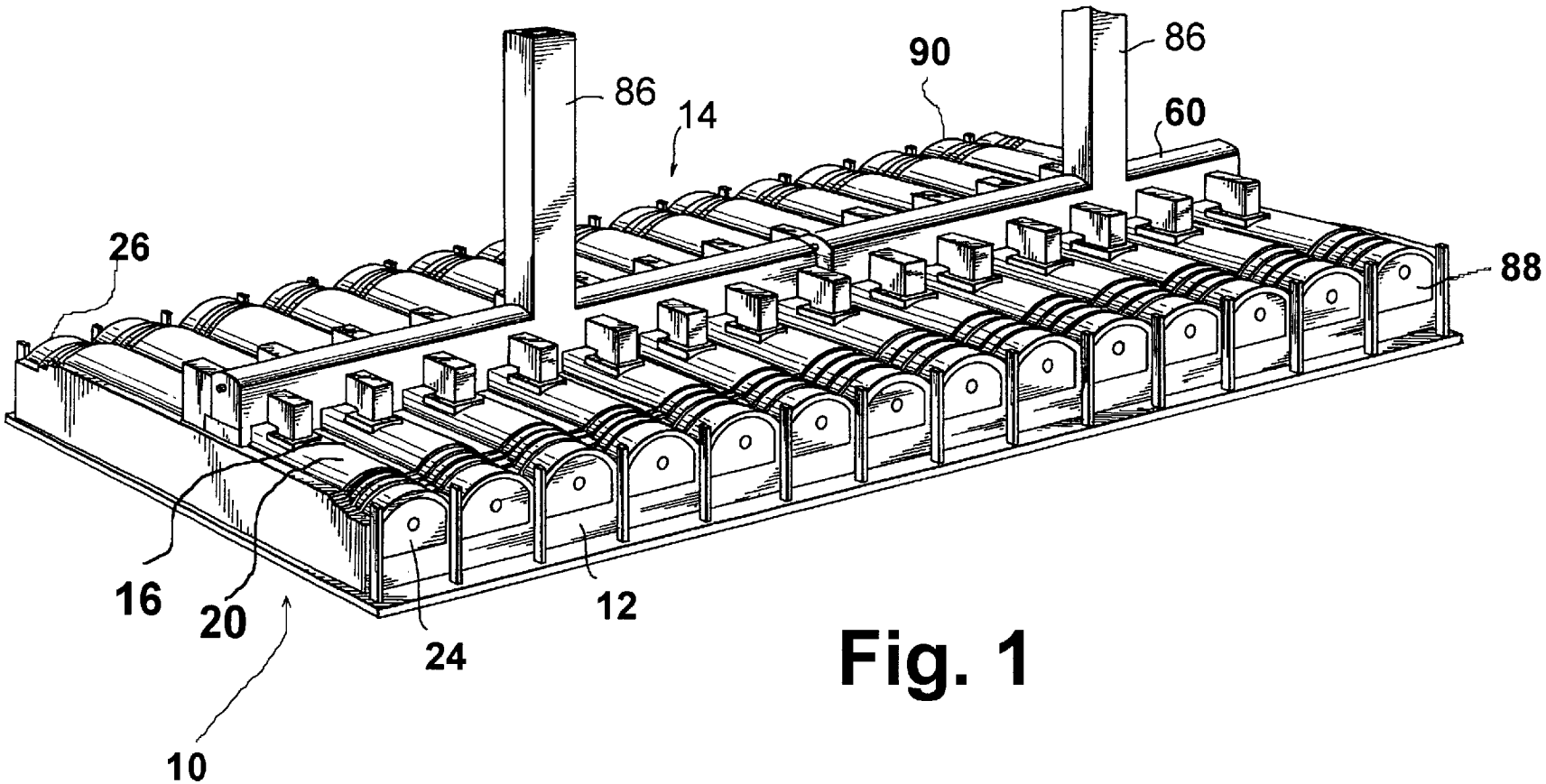
FIG. 1 is an isometric view of a portion of a battery of coke ovens.
Figure 2:
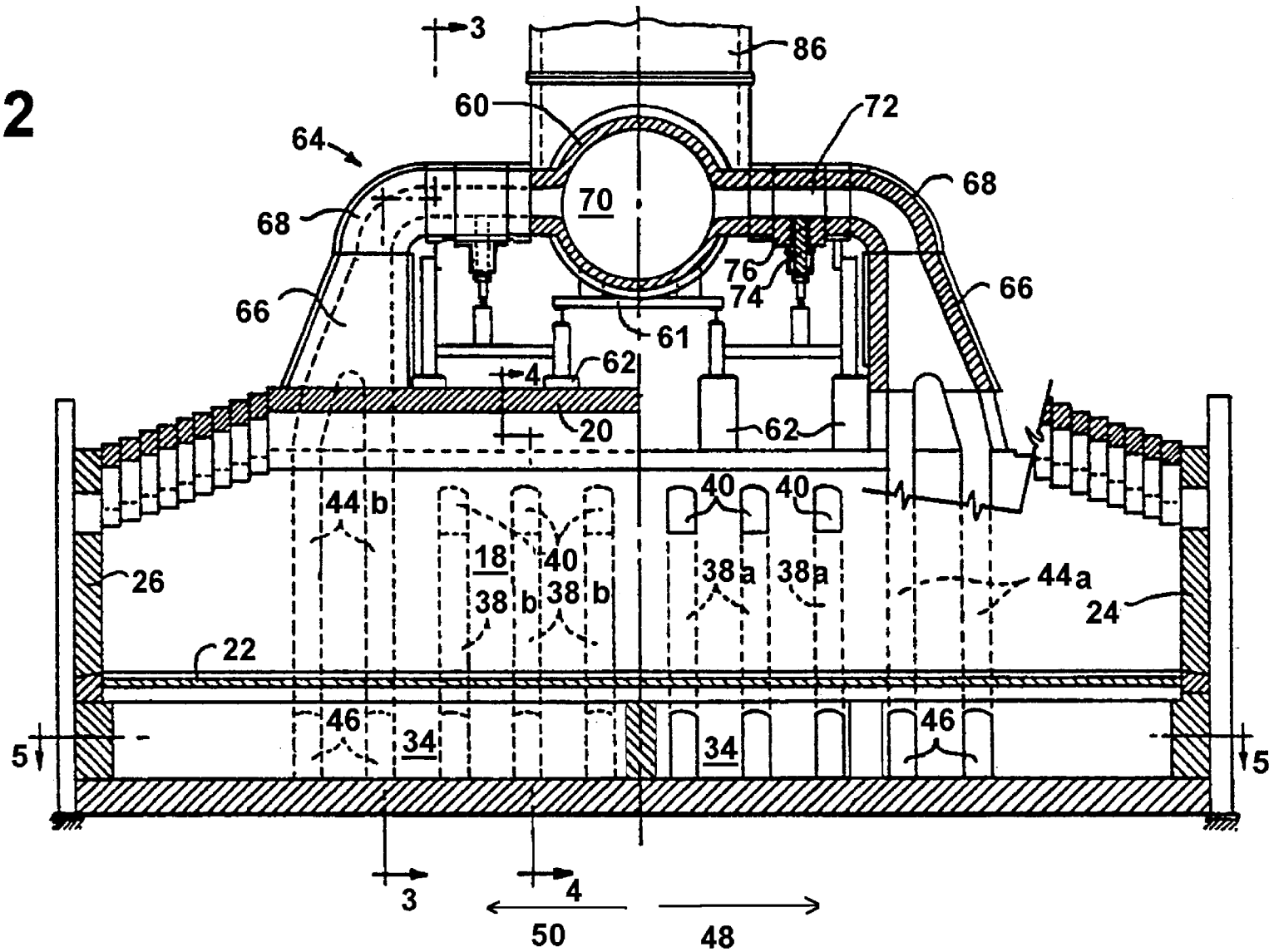
FIG. 2 is a longitudinal sectional view through a coke oven in the battery of coke ovens.

A coal coking plant 10 is illustrated in FIGS. 1 and 2 and includes a plurality of coke ovens 12 preferably constructed in side-by-side relation in a battery 14, with the adjacent ovens 12 in the battery preferably having common sidewalls 16. The individual ovens 12 in the battery 14 each have an elongate coking chamber 18 defined by the opposed vertically extending sidewalls 16, a generally arcuate roof 20 supported on the sidewalls 16, and a horizontal floor 22 which supports the charge of coal to be coked. The ovens are constructed with the opposed ends of the chamber 18 open, and the ends are closed during the coking process by removable doors 24 and 26 (FIG. 2), with door 24 closing the charging end and door 26 closing the coke end of the oven 12. The sidewalls 16, roof 20, and floor 22 are formed from a suitable heat resistant material such as refractory brick or castable refractory material capable of withstanding the high temperatures encountered in the coking process and the thermal shock resulting from the deposit of fresh charges of coal in the heated oven chambers 18.

Figure 3:
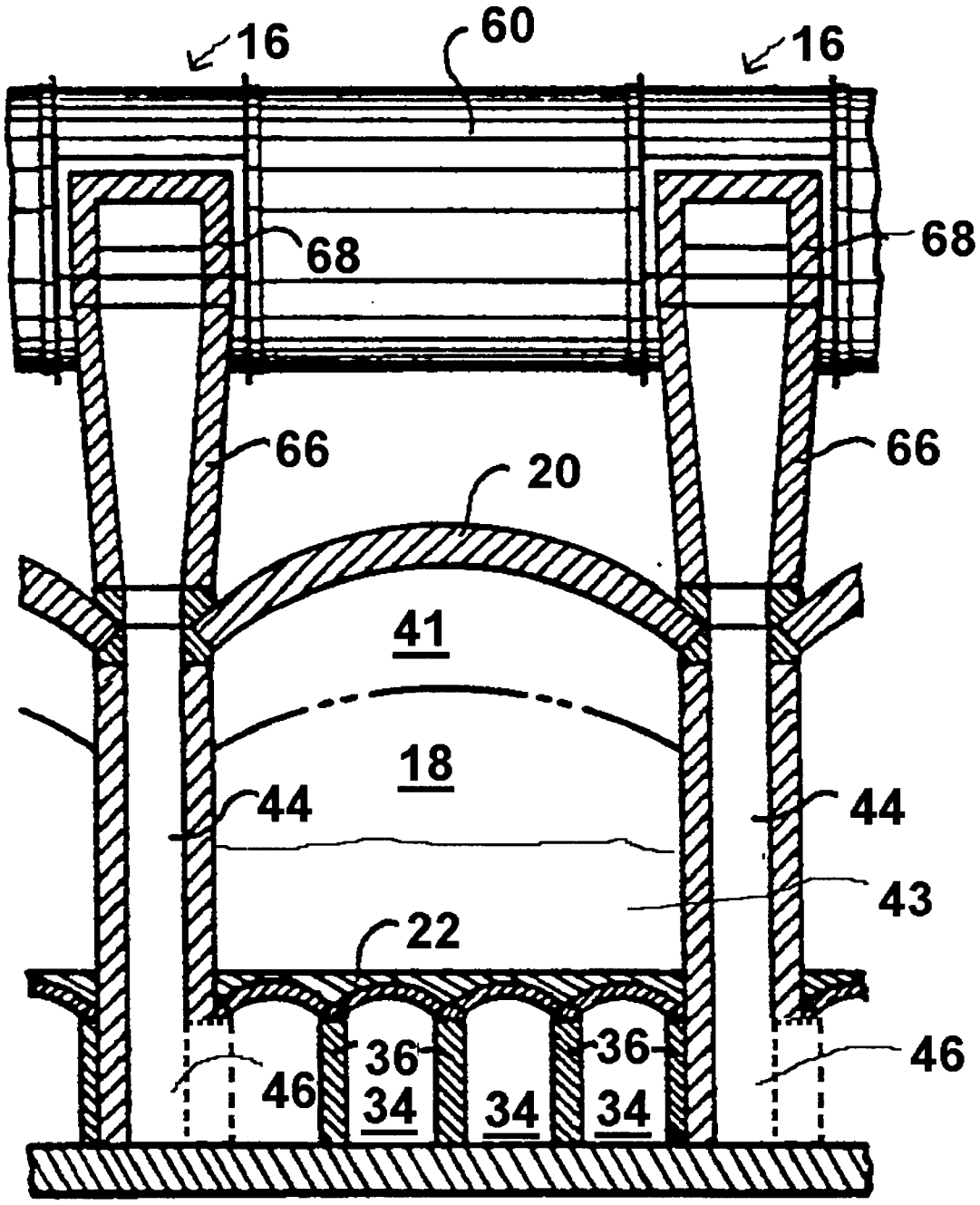
FIG. 3 is an enlarged fragmentary sectional view, taken on line 3—3 of FIG. 2, showing a coke oven interior, combustion gas tunnel and sole flue system.
Figure 4A:
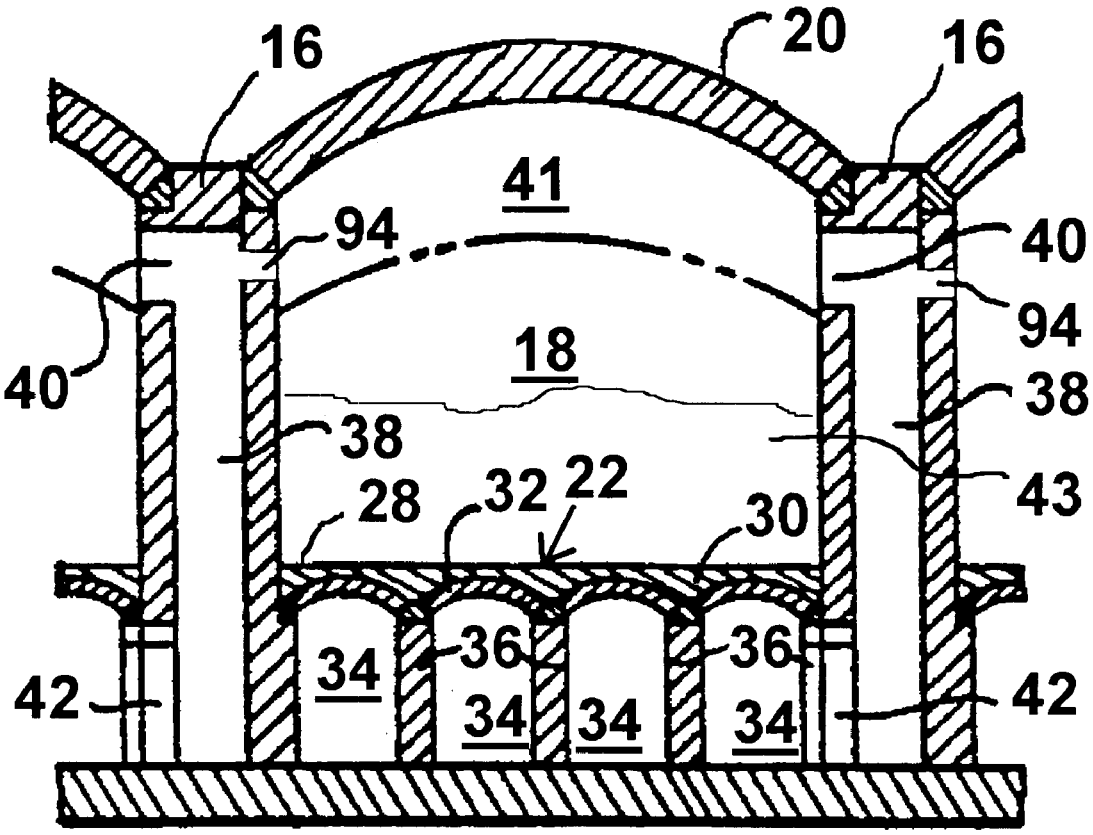
FIGS. 4A and 4B are an enlarged fragmentary sectional views, taken on line 4—4 of FIG. 2, showing coke oven interiors and sole flue systems.

As best seen in FIGS. 3 and 4, the floor 22 preferably consists of a top layer 28 of refractory brick resting upon a bed 30 of castable refractory material which is cast over the brick arch tops 32 of a system of generally rectangular, elongate sole flue chambers 34 extending beneath each oven chamber 18. The arch tops 32 are supported by oven sidewalls 16 and by a plurality of parallel intermediate refractory brick sidewalls 36, with the oven sidewalls 16 and the intermediate sidewalls 36 cooperating to define the elongate sole flue chambers 34 beneath the floor 22 the entire length of the elongate coking chamber 18. As described in more detail below, the sole flue gas system may include separate sole flue chamber sections beneath the chamber floor 22.

A plurality of vertically extending downcomers, or channels 38 are preferably formed in the sidewalls 16, with the respective downcomers 38 having an inlet 40 leading from gas space 41 in the upper portion of the respective oven chamber 18 above a coal charge 43 and an outlet 42 leading into the sole flue chamber 34 adjacent the sidewall 16 in which the downcomer 38 is formed (FIG. 4). One or more uptakes, or chimneys 44, are also formed in the sidewalls 16, with each chimney 44 having an inlet 46 in its base leading from the adjacent sole flue chamber 34 adjacent the sidewall 16 in which the chimney 44 is formed. The chimneys 44 extend upwardly through the sidewalls 16 to a point spaced above the roof 20 as more fully described hereinbelow.

Figure 5:
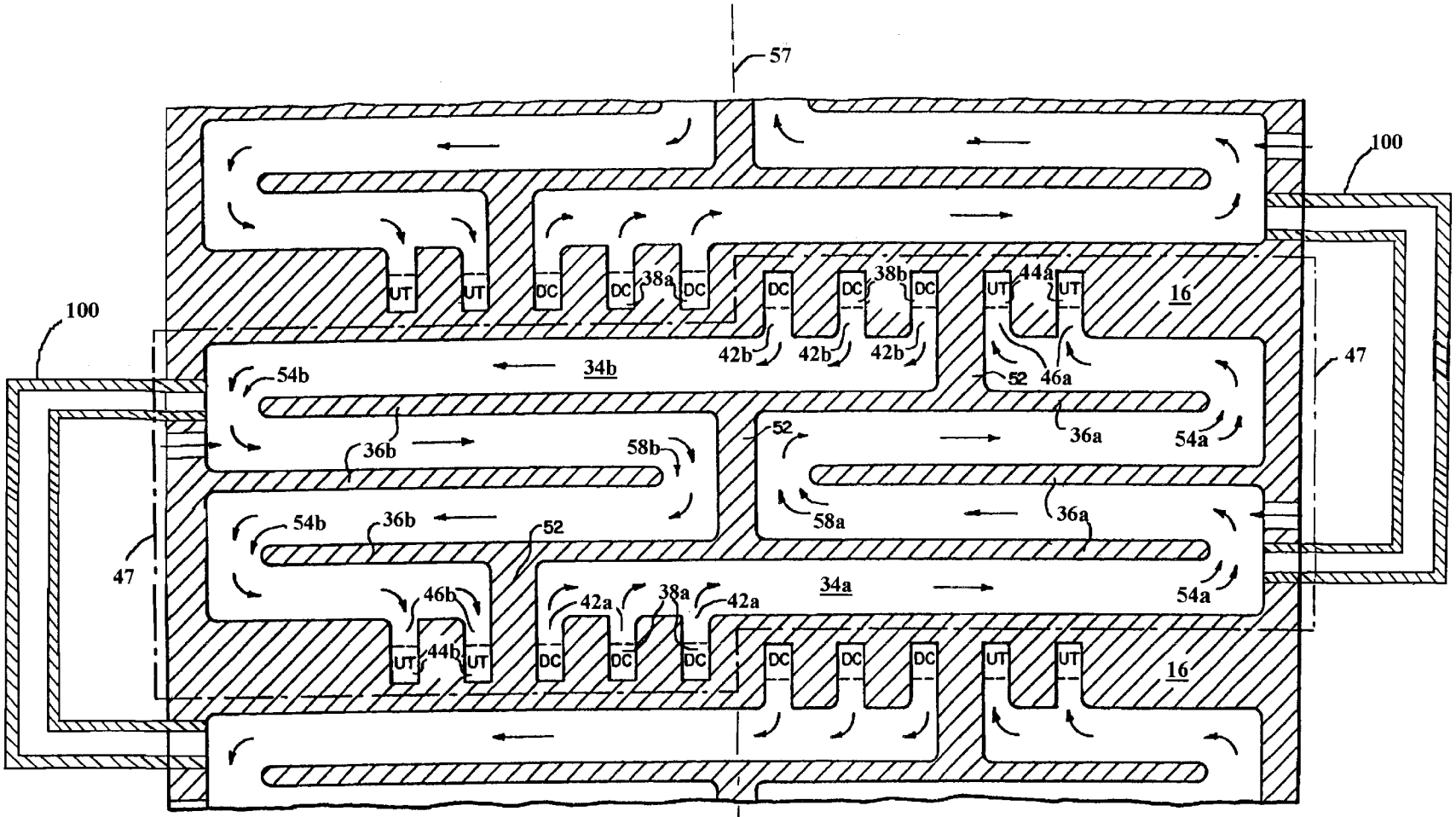
FIG. 5 is a plan view of a sole flue system for a coke oven according to the invention.

The downcomers 38, sole flue chambers 34, and chimneys 44 associated with the sole flue gas system 47 (the area enclosed by the broken lines in FIG. 5) for each oven 12 are preferably arranged in two separate sole flue gas sections 48 and 50 as illustrated in FIG. 5. Thus, the structure enclosed below floor 22 shown in FIG. 5 constitutes the sole flue gas system 47 for a single oven 12. As shown in FIG. 5, each section 48 and 50 of the sole flue gas system 47 preferably contains at least 3 downcomers 38*a* or 38*b* and at least one chimney 44*a* or 44*b*, preferably two chimneys 44*a* or 44*b* in each sidewall 16. The downcomers 38*a* are disposed in sole flue gas section 48 with chimney 44*a* being in the opposing sidewall 16 from the downcomers 38*a*. Likewise, the downcomers 38*b* are disposed in sole flue gas section 50 with chimney 44*b* being in the opposing sidewall 16 from the downcomers 38*b*. A series of divider walls 52 extend perpendicular to the intermediate walls 36*a* and 36*b* and sidewalls 16 and divide the sole flue gas system 47 into sections 48 and 50 isolated from one another on opposite ends of each oven 12. The intermediate walls 36*a* and 36*b* in each section 48 or 50 provide a labyrinth path through each section 48 or 50 the full width of the coking chamber 18 of each oven 12 by providing a gas flow path through the gaps 54*a* or 54*b* between the intermediate walls 36*a* and 36*b* and end walls 56*a* and 56*b*. Likewise gaps 58*a* and 58*b* are provided between intermediate walls 36*a* and 36*b* and divider walls 52 for gas flow therethrough from the downcomers 38*a* and 38*b* to the chimneys 44*a* and 44*b*.

Accordingly, in the sole flue system 47 for each oven 12, gas flows from the gas space 41 in the upper portion of the oven chamber 18 adjacent the roof 20 through the downcomers 38*a* in the right-hand end of wall 16 (FIG. 2 and 5 ), into a sole flue section 48 across the width of the oven 12 and out through a chimney 44*a* in wall 16 on the opposing side of the sole flue gas section 48. Similarly, downcomers 38*b* in the left end of wall 16, (FIGS. 2 and 5 ) provide a gas flow pattern from the gas space 41 in the upper portion of the oven chamber 18 into the sole flue gas section 50 to flow in a back-and-forth pattern transversely across the width of the oven 12 to exit through a chimney 44*b* in wall 16, so that the gas flows transverse the oven 12 in the sole flue gas sections 48 and 50 in opposite directions on opposite longitudinal ends of the oven 12.

As best seen in FIGS. 1 and 2, a plurality of elongated combustion tunnels 60 extend above the arcuate roofs 20 of ovens 12 throughout essentially the full length of the battery 14 with each tunnel 60 preferably extending over a group adjacent ovens 12, preferably at least about 6 ovens. The tunnels 60 are constructed of refractory brick or other suitable high temperature resistant material and are supported on steel beams 61 which, in turn, are supported on upstanding blocks, or columns 62 supported on the top of each of the sidewalls 16. The blocks 62 may be formed of any suitable load-bearing material such as concrete or refractory brick.

Duct systems 64 connecting the chimneys 44 of each sole flue gas system 47 to the tunnels 60 are supported on the top of each sidewall 16 adjacent the tunnel support blocks 62, with the chimneys 44*a* and 44*b* in the respective sidewalls 16 discharging into the interior of duct systems 64. Each duct system 64 includes chimney extension transition 66 and an elbow section 68 for directing gas flow from the sole flue heating systems 48 and 50 into a longitudinally extending interior channel 70 of the tunnel structure 60. Chimney extension transition 66 and elbow section 68 are formed from refractory brick or other suitable material capable of withstanding the intense heat of the gas from the sole flue gas system 47.

A draft control valve 72 including a vertically moveable refractory valve plate 74 and valve body 76 is preferably mounted between each elbow section 68 and the tunnel 60 for movement between a lowered position shown in FIG. 2 for direct gas flow communication between the chimneys 44 and the interior channel 70 of the tunnel 60 and a raised position for stopping gas flow from the flue gas system 47 into the interior channel 70 of the tunnel 60. The draft control valve 72 is used to control the rate of combustion air drawn into the gas space 41 and into the sole flue chamber 34. The draft control valve 72 is also used to direct coal volatiles to either the sole flue gas section 48 or 50 (FIG. 5) if there is a temperature imbalance in either sole flue gas section 48 or 50. Generally the draft control valve plate 74*b* is totally open during the early part of a coking cycle and is gradually closed off during the latter stages of the coking cycle. Any suitable means, such as a pneumatic cylinder, gear motor or the like may be used to move the refractory valve plate 74 from the open to the closed position. Details of a suitable valve 72 may be found in U.S. Pat. No. 5,114,542 to Childress, et al., the disclosure of which is incorporated herein by reference as if fully set forth.

Tunnel 60 is preferably operated under a subatmospheric pressure ranging from about −0.3 to about −0.5 inches of water to provide a draft of gases into tunnel 60 from the flue gas systems 47. Subatmospheric pressure in tunnel 60 may be provided by natural draft or by induced draft fans including dampers.

Gases from the interior channel 70 of the combustion tunnel 60 may be discharged to the atmosphere at the top of vertically extending stacks 86 which are in direct fluid communication with the combustion tunnel 60 at the base of the stacks 86 or the combustion gases may be directed to a heat recovery system for generating steam. The stacks 86 are supported on the top of the tunnel 60, directly above one of the sidewalls 16 of the ovens 12, with the base of the stacks 86 opening directly into the channel 70 of the combustion tunnel 60.

Ovens according to the present invention are preferably charged with powdered or compacted coal through the front door by use of a pushing and charging machine of the type disclosed in U.S. Pat. Nos. 3,784,034; 4,067,462; 4,287,024 and 4,344,820 to Thompson and U.S. Pat. No. 5,447,606 to Pruitt, the disclosures of which are incorporated herein by reference as if fully set forth. Such a charging machine preferably runs on rails extending parallel to and in front of the battery 14 of ovens 12 adjacent doors 24. A door handling assembly on the charging machine is adapted to engage oven door 24 to remove and support the door 24 during coke pushing and oven charging operations. Coal to be coked is fed into the oven 12, filling the oven to the desired depth from charging end 88 progressively to coke discharge end 90 of the oven 12.

After an oven 12 is completely charged with coal, the door 24 is lowered and secured in position on the charging end 88 of the oven sealing the oven 12. Due to the draft in the flue gas system 47, a slight negative pressure is immediately created in gas space 41 in the upper portion of the charged oven 12 adjacent the roof 20 as soon as the door 24 is secured, so that there is reduced tendency for oven gases to escape around the doors 24 or 26 during the coking process.

After the coking operation is completed, door 26 is removed from the coke discharge end 90 of the oven 12. The coke is pushed from the oven 12 through a coke guide into a hot coke car supported on rails adjacent coke discharge end 90 of the coke oven 12. The incandescent coke removed from the oven 12 is then moved in the hot coke car to a quenching station where water is dumped onto the coke for quenching.

An important feature of the invention is a sole flue gas sharing system used to control oven temperature during the initial coking operation. Until now, each coke oven 12 has been operated substantially independently of adjacent coke ovens 12. Flue gas sharing provides a substantial improvement in coke oven operations enabling greater oven charge capacity, lower emissions, and/or shorter coking times.

From the standpoint of volatile emissions from coal during the coking operation, the evolution of volatile matter from a coal charge to an oven 12 is not constant over the duration of the coking cycle. For a typical coking cycle of 48 hours, volatile matter evolving from the coal is highest during the first 3 hours after charging an oven 12 with coal. The initial volume of volatile matter evolving from the coal may be as high as two to three times the average volume of volatile matter evolving from the coal over the coking cycle. After the first 3 hours, the volume of volatile matter decreases gradually to the average rate for the next about 4 to about 36 hours. Thereafter, the volume of volatile matter gradually decreases to approximately ⅕ to 1/10 the average volume of volatile matter for the period of time from about 36 to about 48 hours into the coking cycle.

The amount of volatile matter evolving from the coal is also dependent on the amount of coal charged to the oven 12, the moisture content of the coal and the volatiles content of the coal. Coal having a low moisture content, no more than about 6% by weight, and a high volatile matter content, more than about 26 to about 28% by weight, may result in exceeding the capacity of the oven to handle increased combustion gas flows resulting in higher sole flue temperatures, greater than about 2700° F., thereby causing heat damage to the sole flue arches 32 and oven floors 22.

With reference again to FIG. 4A, one means for providing flue gas sharing between adjacent ovens 12 is illustrated. According to one aspect of the invention, a flue gas passage 94 is provided in sidewall 16 of the oven 12 to direct volatile matter from the gas space 41 in chamber 18 above the coal charge 43 into the downcomer 38 one or more adjacent ovens 12. It is contemplated that the adjacent oven(s) 12 will be further along in the coking cycle whereby the volume of volatile matter evolving from the coal in the adjacent oven(s) 12 is substantially below that of the recently charged oven.

Figure 4B:
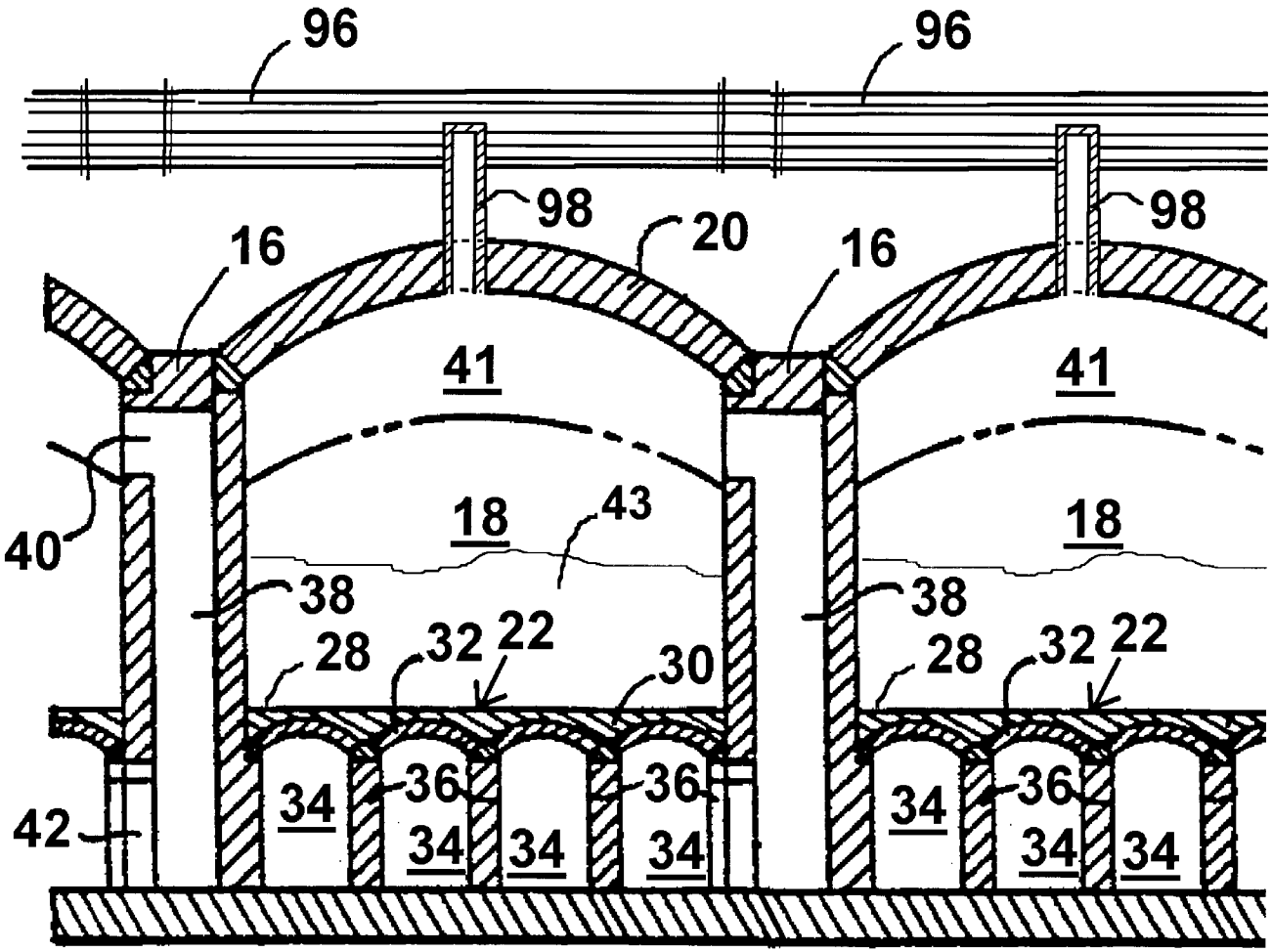

Another means for flue gas sharing is to provide external refractory-lined ducts 100 (FIG. 5) between the sole flue chambers 34 of adjacent ovens 12 or refractory-lined jumper pipes 96 and jumper pipe connectors 98 connecting the gas spaces 41 in the upper portions of chambers 18 of adjacent ovens through roofs 20 or through the oven walls 16 (FIG. 4B). For existing coking ovens 12, it is particularly preferred to provide jumper pipes through the oven roofs 20 to provide for flow of volatile matter from the gas space 41 of a first oven 12 into gas space 41 of an adjacent oven 12. New ovens 12 may be constructed with openings or apertures in the common oven walls 16 between the ovens thereby connecting the gas spaces 41 of the ovens in gas flow communication with one another.

The cross-sectional flow area of the flue gas passage 94 or jumper pipes 96 for a coke oven 12 preferably ranges from about 1.5 to about 1.8 $ft^2$ per 100 tons of coal charged to the coke oven. With regard to the design flow rate of the jumper pipes, a cross-sectional flow area ranging from about 0.55 to about 0.62 $ft^2$ per 1000 scfm of gas flow is preferred. It will be recognized that new coke ovens 12 may be initially constructed with a suitable flue gas sharing system selected from the systems described above. The system is adaptable to flue gas sharing between at least two ovens 12 and may be used for flue gas sharing between three ovens, four ovens or all of the ovens in a coke battery 14. From an operational point of view, it is preferred to share flue gas between two, three or four ovens 12 in a coke oven battery 14.

Proper design of the jumper pipes for sufficient gas flow preferably eliminates the need for gas flow regulation in the jumper pipes. However, if desired, suitable flow control systems may be used to further adjust the flow of flue gas shared between ovens. Furthermore, a system may be provided for flue gas sharing between a recently charged oven and any other oven in the coke battery 14 by use of a common conduit connecting the gas space 41 of all of the ovens in the coke battery 14 and gas shut off valves between the common conduit and each of the ovens 12. The amount of flue gas shared between ovens may also be controlled by adjusting the refractory valve 72 as described above to change the rate of combustion air drawn into the gas space 41 and sole flue chamber 34 of the oven 12.

The following example is given to illustrate one or more advantages of the invention. In the following table, oven No. 2 is recently charged with 45 tons of coal having a volatile content of 28 wt. % and a moisture content of 6 wt. %. The total crown air into oven No. 2 is assumed to be 280 standard cubic feet per minute (scfm). Oven Nos. 1 and 3 are at 24 hours into the coking cycle. The crown air into oven Nos. 1 and 3 is assumed to be 325 scfm.

TABLE 1

| | No Flue Gas Sharing | | | Flue Gas Sharing from oven No. 2 to oven Nos. 1 and 3 (96 scfm to each). | | |
|---|---|---|---|---|---|---|
| Time in Coking Cycle | Mid Cycle | Recently Charged | Mid Cycle | Mid Cycle | Recently Charged | Mid Cycle |
| Operating Conditions | Oven No. 1 | Oven No. 2 | Oven No. 3 | Oven No. 1 | Oven No. 2 | Oven No. 3 |
| Crown Air | 325 scfm | 280 scfm | 325 scfm | 325 scfm | 280 scfm | 325 scfm |
| Volatiles and water vapor from coal bed | 203 scfm | 501 scfm | 203 scfm | 203 scfm | 501 scfm | 203 scfm |
| Total gas rate in downcomers | 528 scfm | 781 scfm | 528 scfm | 623 scfm | 567 scfm | 623 scfm |
| Combustion air added to sole flues | 1560 scfm | 3500 scfm | 1560 scfm | 2036 scfm | 2457 scfm | 2036 scfm |
| Total gas rate in sole flues | 2088 scfm | 4281 scfm | 2088 scfm | 2659 scfm | 3024 scfm | 2659 scfm |
| Downcomer temperature | 2350° F. | 2000° F. | 2350° F. | 2300° F. | 2000° F. | 2300° F. |
| Sole flue temperature | 2400° F.–2650° F. | 2800° F.–3000° F. | 2400° F.–2650° F. | 2400° F.–2650° F. | 2400° F.–2650° F. | 2400° F.–2650° F. |

As seen by comparing flue gas flow rates given in the foregoing table, flue gas sharing between oven No. 2 and oven Nos. 1 and 3 significantly decreases the gas flow in the sole flue for oven No. 2 more than about 25 percent and thus decreases the temperature the sole flue and oven floor are exposed to given the air flow and fuel conditions indicated. Accordingly, diverting volatile gases from oven No. 2 during the initial coking cycle with one or more adjacent ovens is effective to reduce the gas flow rate of volatiles generated by a recently charged coke oven so that the design capacity with respect to temperature and gas flow rate of the sole flue gas system is not exceeded. Otherwise, additional combustion air is needed to compensate for the increased fuel value of the flue gas during the initial coking operation thereby exceeding the design flow rate of gas in the flue gas system and/or increasing oven pressure thereby reducing the draft on the oven.

Other non-limiting benefits of the invention include reduction in charging emissions due to increased draft in the oven being charged, increased oven life due to decreased sole flue temperatures, increased oven yield due to lower infiltration air in adjacent coke ovens, easier oven operation due to a reduction in the peak volatile flow rate and better combustion conditions in the ovens thereby lowering air pollution emissions.

It is believed apparent that various modifications might be made in the structure described above without departing from the spirit and scope of the invention. Thus, while preferred embodiments of the invention have been specifically disclosed, it is understood that the invention is not intended to be restricted solely thereto, but rather is intended to include all embodiments thereof which would be apparent to one skilled in the art and which come within the spirit and scope of the invention.

What is claimed is:

1. A coke oven battery comprising at least a first coke oven and at least a second coke oven, each of the first and second coke ovens containing a coking chamber defined by chamber sidewalls, chamber roof and chamber floor, wherein each coking chamber includes a gas space above a coke bed and wherein the chamber floor below the coke bed of the first coke oven is heated by a first sole flue gas system, the chamber floor of the second coke oven is heated by a second sole flue gas system and wherein at least one of the chamber sidewalls between the first and second coke ovens contains at least one downcomer in flow communication between the gas space of the first coking chamber and the first sole flue gas system for directing flue gases from the gas space of the first coking chamber to the first sole flue gas system and the coke oven battery contains a connecting gas conduit in gas flow communication between the gas space of the first coking chamber and the gas space of at least the second coking chamber or the sole flue gas system of at least the second coke oven for directing at least a portion of flue gas from the gas space of the first coking chamber to the second coke oven whereby the flue gas flow rate in the first sole flue gas system is decreased with respect to a first coke oven in the absence of said gas conduit.

2. The coke oven battery of claim 1 wherein the first and second coke ovens each contain a sole flue gas system having separate first and second sole flue gas sections and at least one downcomer from the coking chamber of the respective ovens to each of the first and second sole flue gas sections.

3. The coke oven battery of claim 2 wherein each downcomer has an inlet in flow communication with the coking chamber and an outlet in flow communication with the sole flue gas system.

4. The coke oven battery of claim 1 wherein each downcomer has an inlet in flow communication with the coking chamber and an outlet in flow communication with the sole flue gas system.

5. The coke oven battery of claim 1 wherein the chamber sidewall between the first and second coke ovens is a chamber sidewall shared by the first and second coke ovens.

6. The coke oven battery of claim 5 wherein the chamber sidewall between the first and second coke ovens is a refractory chamber sidewall including refractory bricks.

7. The coke oven battery of claim 6 wherein the gas conduit comprises an aperture in the chamber sidewall provided by removal of refractory bricks from the chamber sidewall to provide gas flow communication between the first coking chamber and second coking chamber or the downcomer of the second sole flue gas system.

8. The coke oven battery of claim 1 wherein the chamber sidewalls between the first and second coke ovens are refractory chamber sidewalls including refractory bricks.

9. The coke oven battery of claim 8 wherein the gas conduit comprises an aperture in the chamber sidewalls provided by removal of refractory bricks from the chamber sidewalls to provide gas flow communication between the first coking chamber and the second coking chamber or the downcomer of the second sole flue gas system.

10. The coke oven battery of claim 1 wherein gas conduit comprises a cross-over duct between the first gas space and the gas space of at least the second coke oven.

11. The coke oven battery of claim 1 wherein the gas conduit comprises a connecting duct between the gas space of the first coke oven and the gas space of at least the second coke oven or the downcomer of the second coke oven.

12. A flue gas sharing system for a coke oven battery containing at least a first coke oven and a second coke oven, the first coke oven having a first sole flue gas system, a first coking chamber and a first gas space above a coke bed in the first coking chamber, and the second coke oven having a second sole flue gas system, a second coking chamber and a second gas space above a coke bed in the second coking chamber, the flue gas sharing system comprising a refractory lined duct in gas flow communication between the first gas space and at least the second gas space or the second sole flue gas system whereby a flue gas flow rate in the first sole flue gas system is reduced compared to a flue gas flow rate in the first sole flue gas system in the absence of the refractory lined duct.

13. The flue gas sharing system of claim 12 wherein the first and second coke ovens each contain a sole flue gas system having separate first and second sole flue gas sections and at least one downcomer from the coking chamber to each of the first and second sole flue gas sections.

14. The flue gas sharing system of claim 13 wherein each downcomer has an inlet in flow communication with the coking chamber and an outlet in flow communication with the sole flue gas system.

15. The flue gas sharing system of claim 12 wherein each coke oven contains a downcomer having an inlet in flow communication with the coking chamber and an outlet in flow communication with the sole flue gas system.

16. A flue gas sharing system for a coke oven battery containing at least a first coke oven and a second coke oven, the first coke oven having a first sole flue gas system and a first coking chamber and the second coke oven having a second sole flue gas system and a second coking chamber, the flue gas sharing system comprising a refractory lined duct in gas flow communication between the first coking chamber and the second coking chamber whereby a flue gas flow rate in the first sole flue gas system is reduced compared to a flue gas flow rate in the first sole flue gas system in the absence of the refractory lined duct.

17. The flue gas sharing system of claim 16 wherein the first and second coke ovens each contain a sole flue gas system having separate first and second sole flue gas sections and at least one downcomer from the coking chamber to each of the first and second sole flue gas sections.

18. The flue gas sharing system of claim 17 wherein each downcomer has an inlet in flow communication with the coking chamber and an outlet in flow communication with the sole flue gas system.

19. The flue gas sharing system of claim 16 wherein each coke oven contains a downcomer having an inlet in flow communication with the coking chamber and an outlet in flow communication with the sole flue gas system.

20. A flue gas sharing system for a coke oven battery containing at least a first coke oven and a second coke oven, the first coke oven having a first sole flue gas system and a first coking chamber and the second coke oven having a second sole flue gas system and a second coking chamber, the flue gas sharing system comprising a refractory lined duct in gas flow communication between the first sole flue gas system and the second sole flue gas system whereby a flue gas flow rate in the first sole flue gas system is reduced compared to a flue gas flow rate in the first sole flue gas system in the absence of the refractory lined duct.

21. The flue gas sharing system of claim 20 wherein the first and second coke ovens each contain a sole flue gas system having separate first and second sole flue gas sections and at least one downcomer from the coking chamber to each of the first and second sole flue gas sections.

22. The flue gas sharing system of claim 21 wherein each downcomer has an inlet in flow communication with the coking chamber and an outlet in flow communication with the sole flue gas system.

23. The flue gas sharing system of claim 20 wherein each coke oven contains a downcomer having an inlet in flow communication with the coking chamber and an outlet in flow communication with the sole flue gas system.

24. A method for decreasing gas flow rates in a sole flue gas system for a coke oven during at least an initial coking operation after charging a coking oven with coal, the method comprising providing a duct system between a first coke oven having a first coking chamber, a first gas space above a coke bed and a first sole flue gas system and a second coke oven having a second coking chamber, a second gas space above a second coke bed and a second sole flue gas system to direct at least a portion of gas in the first gas space to at least the second gas space or the second sole flue gas system for the second coke oven thereby reducing a gas flow rate in the first sole flue gas system of the first coke oven.

25. The method of claim 24 wherein duct system includes a downcomer in a chamber sidewall made of refractory bricks, the chamber sidewall being shared by the first and second coke ovens, the downcomer having an inlet in gas flow communication with the first gas space and an outlet in gas flow communication with the first sole flue gas system for the first coke oven, the method further comprising removing one or more refractory bricks from the chamber sidewall to provide an aperture for gas flow communication between the first gas space and the second gas space or the second sole flue gas system.

26. The method of claim 24 wherein flue gas sharing between the first and second coke ovens is provided by connecting the duct system between the first sole flue gas system and the second sole flue gas system.

27. The method of claim 24 wherein flue gas sharing between the first and second coke ovens is provided by connecting the duct system between the first gas space and the second sole flue gas system.

28. The method of claim 22 wherein flue gas sharing between the first and second coke ovens is provided by connecting the duct system between the first gas space and the second gas space.

* * * * *